US007574824B2

(12) United States Patent
Holmberg

(10) Patent No.: US 7,574,824 B2
(45) Date of Patent: Aug. 18, 2009

(54) DEVICE MOUNT FOR A FIREARM

(76) Inventor: Larry Holmberg, P.O. Box 63, Wascott, WI (US) 54890

( * ) Notice: Subject to any disclaimer, the term of this patent is extended or adjusted under 35 U.S.C. 154(b) by 0 days.

(21) Appl. No.: 11/327,123

(22) Filed: Jan. 6, 2006

(65) Prior Publication Data

US 2007/0157502 A1 Jul. 12, 2007

(51) Int. Cl.
*F41C 27/00* (2006.01)

(52) U.S. Cl. ..... 42/106; 42/124; 396/419

(58) Field of Classification Search ..... 42/124, 42/125, 126, 127, 148, 106; 40/700; 89/41.05; 396/419

See application file for complete search history.

(56) References Cited

U.S. PATENT DOCUMENTS

| | | | | |
|---|---|---|---|---|
| 521,761 | A | | 6/1894 | Day |
| 899,639 | A | | 9/1908 | Vibber |
| 1,480,147 | A | | 1/1924 | Fokko |
| 2,101,479 | A | | 12/1937 | Schenk |
| 2,450,466 | A | | 10/1948 | Carlson |
| 2,814,118 | A | * | 11/1957 | Evans et al. ..... 42/120 |
| 3,427,102 | A | | 2/1969 | Wade |
| 3,483,623 | A | | 12/1969 | Kruzell |
| 3,684,376 | A | | 8/1972 | Lessard |
| 3,782,822 | A | | 1/1974 | Spence |
| 3,834,052 | A | | 9/1974 | Steck, III |
| 4,027,414 | A | | 6/1977 | Felix |
| 4,233,770 | A | | 11/1980 | de Filippis et al. |
| T101,001 | I4 | | 9/1981 | Shipp et al. |
| 4,296,725 | A | | 10/1981 | Broderick |
| D268,910 | S | | 5/1983 | Shipp et al. |
| 4,516,296 | A | | 5/1985 | Sherman |
| 4,531,052 | A | | 7/1985 | Moore |
| 4,597,211 | A | | 7/1986 | Miles |
| 4,617,741 | A | | 10/1986 | Bordeaux et al. |
| 4,640,258 | A | | 2/1987 | Penney et al. |
| 4,643,159 | A | | 2/1987 | Ryan |
| 4,730,190 | A | | 3/1988 | Win et al. |
| 4,753,528 | A | | 6/1988 | Hines et al. |
| 4,777,352 | A | | 10/1988 | Moore |
| 4,786,204 | A | | 11/1988 | Mayeda |
| 4,835,621 | A | | 5/1989 | Black |
| 4,890,128 | A | | 12/1989 | Kania |
| 4,910,717 | A | | 3/1990 | Terry |
| 4,939,863 | A | | 7/1990 | Alexander et al. |
| D313,361 | S | | 1/1991 | Robinson |

(Continued)

FOREIGN PATENT DOCUMENTS

| | | |
|---|---|---|
| EP | 1804017 A1 | 7/2007 |

(Continued)

*Primary Examiner*—Michael Carone
*Assistant Examiner*—Benjamin P Lee
(74) *Attorney, Agent, or Firm*—Kinney & Lange, P.A.

(57) ABSTRACT

A mount for mounting a device to a firearm that includes a side plate, a support plate and a mounting rail. The side plate has a first end and a second end. The support plate extends from the first end of the side plate at approximately a right angle. Moreover, the support plate is adapted to support a device resting thereon. The mounting rail is coupled to the second end of the side plat. In addition, the mounting rail extends out from the side plate in a direction that is approximately opposite the direction the support plate extends from the side plate.

16 Claims, 13 Drawing Sheets

U.S. PATENT DOCUMENTS 4,993,833 A 2/1991 Lorey et al.
5,020,262 A 6/1991 Pena
5,026,158 A 6/1991 Golubic
5,373,657 A 12/1994 Betz et al.
5,479,712 A 1/1996 Hargrove et al.
5,520,164 A 5/1996 Huddleston
D371,084 S 6/1996 Ogawa
5,531,149 A 7/1996 Schubert et al.
5,575,072 A 11/1996 Eldridge
5,611,324 A 3/1997 Kursinsky
5,669,174 A 9/1997 Teetzel
5,687,910 A 11/1997 King
D390,483 S 2/1998 Zykan et al.
5,815,251 A 9/1998 Ehbets et al.
5,859,693 A 1/1999 Dunne et al.
5,887,375 A * 3/1999 Watson ..... 42/106
5,911,215 A 6/1999 Fisher, Jr.
5,926,260 A 7/1999 Dunne et al.
5,937,562 A 8/1999 Brough
5,949,529 A 9/1999 Dunne et al.
5,973,315 A 10/1999 Saldana et al.
D421,229 S 2/2000 Imai
6,070,355 A 6/2000 Day
6,073,352 A 6/2000 Zykan et al.
D432,930 S 10/2000 Sanoner
6,137,564 A 10/2000 Schmidt et al.
6,154,971 A 12/2000 Perkins
6,192,614 B1 * 2/2001 Cliburn ..... 42/106
6,252,706 B1 6/2001 Kaladgew
6,269,581 B1 8/2001 Groh
D488,315 S 9/2001 Ito
6,286,796 B1 9/2001 Pugliesi
6,331,887 B1 12/2001 Shiraishi et al.
6,336,285 B1 1/2002 Baumer
6,396,571 B2 5/2002 Ohtomo et al.
6,397,483 B1 6/2002 Perkins
D460,367 S 7/2002 Apothéloz et al.
D460,368 S 7/2002 Apothéloz et al.
D460,369 S 7/2002 Apothéloz et al.
6,425,697 B1 * 7/2002 Potts et al. ..... 396/426
6,450,816 B1 * 9/2002 Gerber ..... 434/11
6,526,956 B1 3/2003 Hankins
D472,826 S 4/2003 Sanoner
6,556,245 B1 4/2003 Holmberg
6,615,531 B1 9/2003 Holmberg
6,624,881 B2 9/2003 Waibel et al.
6,678,988 B1 1/2004 Poff, Jr.
6,693,702 B2 2/2004 Rogers
6,704,097 B2 3/2004 Waibel et al.
6,772,076 B2 4/2004 Neilsen
6,742,299 B2 6/2004 Strand
6,796,038 B2 9/2004 Humphries
6,819,495 B2 11/2004 Shani et al.
6,866,287 B1 5/2005 Bell et al.
6,886,288 B1 * 5/2005 Yocum et al. ..... 42/127
6,932,305 B2 8/2005 Morales et al.
6,988,331 B2 1/2006 Holmberg
7,006,144 B2 2/2006 Holmberg
7,128,354 B2 * 10/2006 Wu ..... 294/139
7,269,920 B2 9/2007 Staley, III
7,390,130 B2 * 6/2008 Soulvie ..... 396/419
2002/0067475 A1 6/2002 Waibel et al.
2002/0078577 A1 6/2002 Aldred
2002/0109057 A1 8/2002 Wooten et al.
2003/0133092 A1 7/2003 Rogers
2003/0163943 A1 9/2003 Holmberg
2004/0000083 A1 1/2004 Grant, Jr.
2004/0016169 A1 1/2004 Poff, Jr.
2004/0051865 A1 3/2004 Stierle et al.
2004/0079018 A1 4/2004 Holmberg
2004/0114129 A1 6/2004 Gogolla et al.
2004/0135991 A1 7/2004 Gogolla et al.
2004/0183942 A1 * 9/2004 Holmberg ..... 348/373
2004/0194364 A1 10/2004 Holmberg
2004/0257437 A1 * 12/2004 Lesseu ..... 348/61
2005/0035245 A1 2/2005 Morales et al.
2005/0195385 A1 9/2005 Holmberg
2005/0241210 A1 * 11/2005 Karcher et al. ..... 42/119
2005/0252062 A1 11/2005 Scrogin et al.
2005/0268519 A1 12/2005 Pikielny
2007/0031142 A1 * 2/2007 Moody et al. ..... 396/419
2007/0068018 A1 3/2007 Gilmore
2007/0081817 A1 * 4/2007 Soulvie ..... 396/419
2007/0157502 A1 7/2007 Holmberg
2007/0157503 A1 7/2007 Holmberg
2007/0277421 A1 12/2007 Perkins et al.
2008/0000465 A1 1/2008 Holmberg
2008/0060248 A1 3/2008 Pine et al.

FOREIGN PATENT DOCUMENTS

GB 2 024 558 A 1/1980
GB 2 114 770 A 8/1983
WO WO 90/12330 10/1990
WO 2006090356 A1 8/2006
WO 2006133029 A2 12/2006

* cited by examiner

DEVICE MOUNT FOR A FIREARM

BACKGROUND

For game hunters the ability to record the hunt in an efficient manner is desired. Moreover, the ability to attach other devices such as rangefinders and other electronic device to the weapon in a manner that does not impede the hunt is also desired. For the reasons stated above and for other reasons stated below which will become apparent to those skilled in the art upon reading and understanding the present specification, there is a need in the art for a mount that can attach a device such an electronic device to a weapon in an effective and un-intrusive manner.

SUMMARY OF INVENTION

The above-mentioned problems of current systems are addressed by embodiments of the present invention and will be understood by reading and studying the following specification.

In one embodiment, a mount for a device is provided. The mount includes a side plate, a support plate and a mounting rail. The side plate has a first end and a second end. The support plate extends from the first end of the side plate at approximately a right angle. Moreover, the support plate is adapted to support a device resting thereon. The mounting rail is coupled to the second end of the side plat. In addition, the mounting rail extends out from the side plate in a direction that is approximately opposite the direction the support plate extends from the side plate.

In another embodiment, a device mounting rail is provided. The device mounting rial includes a plate, a first rail and a second rail. The plate has a first edge and a second edge. The plate also has a mounting aperture positioned between the first edge and the second edge. In addition, the plate further has a plurality of attaching apertures positioned between the first edge and second edge. The first rail extends from the plate along the first edge of the plate. The second rail extends from the plate along the second edge of the plate in the same direction as the first rail.

In yet another embodiment, a rangefinder having a housing is provided. The housing has a bottom end. The bottom end has a threaded recess and plurality of mounting rail attaching apertures that are adapted to be used to attach a mounting rail to the bottom end of the housing, wherein the threaded recess is aligned with an aperture in the mounting rail when the mounting rail is attached to the rangefinder.

In still another embodiment, a method of attaching a device to a firearm is provided. The method comprises attaching a mounting rail to the device and attaching the mounting rail to a scope mount.

In still further another embodiment, a method of attaching a device to a firearm is provided. The method comprises attaching the device to a mount and attaching a mounting rail of the mount to at least one scope mount, wherein when the device is attached to the firearm the visual operation of the device is approximately at eye level with an aiming mechanism of the scope.

In finally another embodiment, a system to mount a device to a firearm is provided. The system includes a means to attach a device to a mount and a means to attach the mount to the firearm such that a visual operation of the device is essentially at eye level with an aiming device of the scope.

BRIEF DESCRIPTION OF THE DRAWINGS

The present invention can be more easily understood and further advantages and uses thereof more readily apparent, when considered in view of the description of the preferred embodiments and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims and equivalents thereof.

Embodiments of the present invention provide a mount that allows for the attachment of a device such as a video camera, rangefinder or the like, to a weapon. In particular, in one embodiment, the mount allows the device to be mounted to a scope of a weapon in a manner that does not hamper the operation of the scope (i.e. the elevation and/or windage adjustment knob for example) or other operations of the weapon. In another embodiment, a mounting rail adapted to mount a device to a firearm. In yet another embodiment, a rangefinder having a remote port and attaching treads that can be attached to the mount is provided.

Figure 1A:
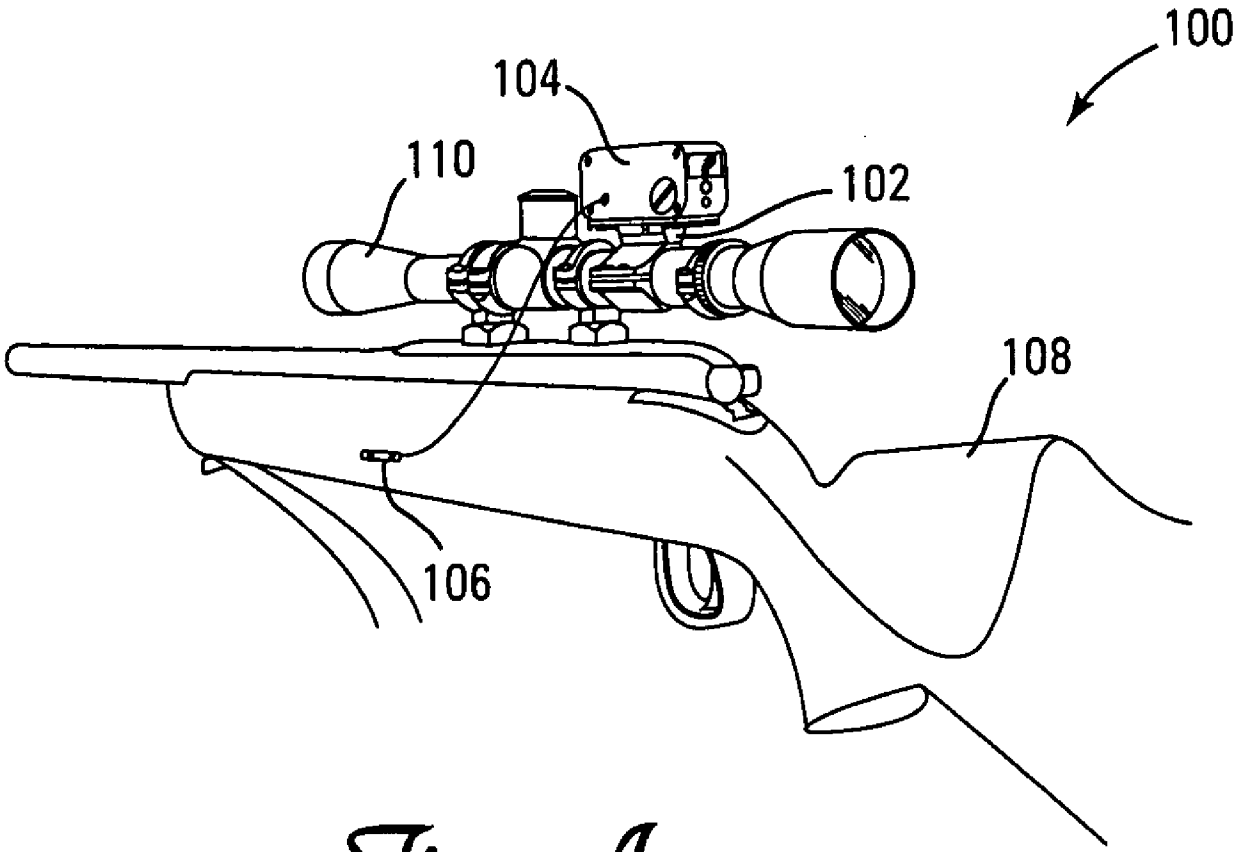
FIG. 1A is a side view of a mounting system of one embodiment of the present invention.
Figure 1B:
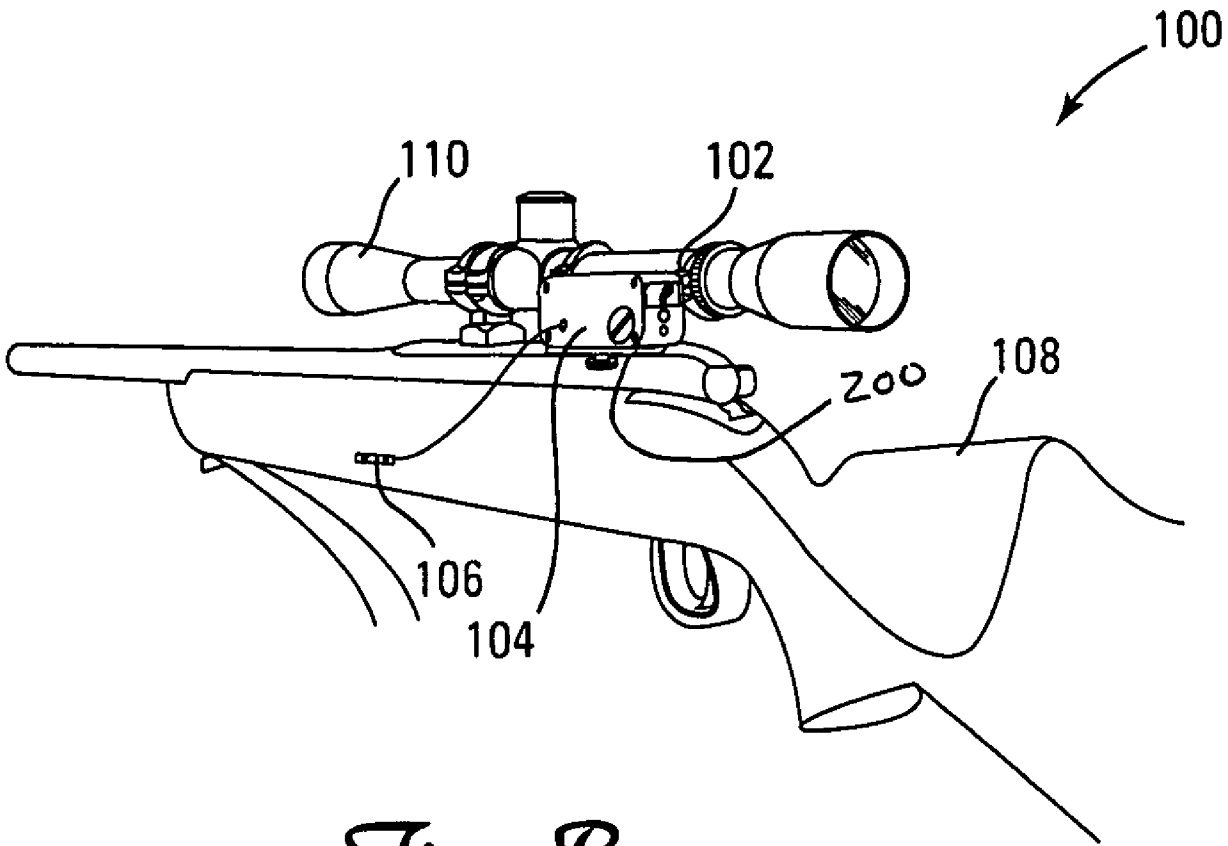
FIG. 1B is a side view of a mounting system of another embodiment of the present invention.

Referring to FIG. 1A, a mounting system 100 of one embodiment of the present invention is illustrated. The mounting system 100 in this embodiment includes a scope 110 that is mounted on a weapon, which is a rifle 108 in this example, and a scope mount 102. The electronic device is a rangefinder 104 in this example that can be operated remotely with a remote control pad 106. In the example of FIG. 1A, the rangefinder 104 is mounted over the scope 110 from a perspective of the hunter. Referring to FIG. 1B, an example of another embodiment in which the rangefinder 104 is mounted on the side of the scope 110 from the perspective of the hunter.

Figure 2B:
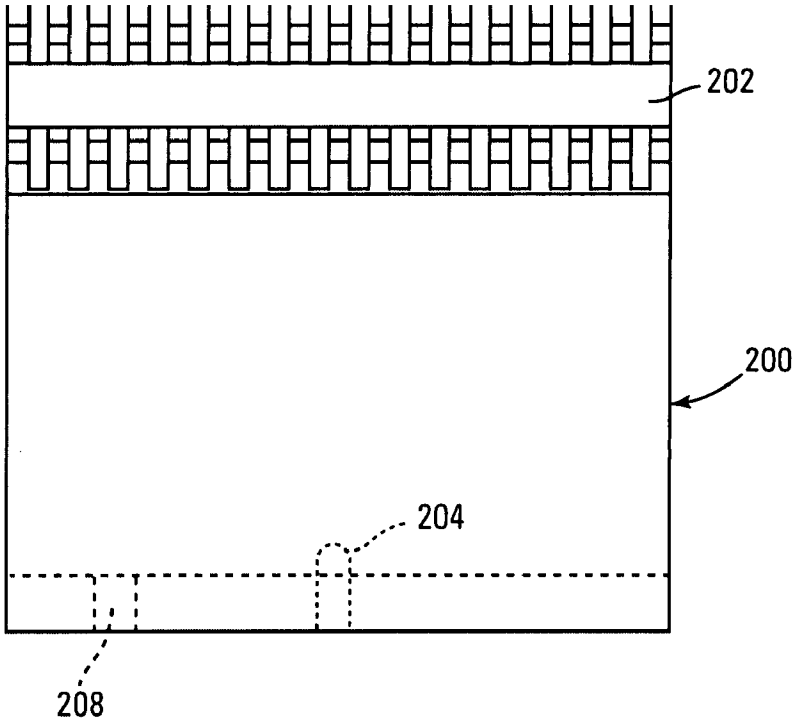
FIG. 2B is a back view of the mount of FIG. 2A illustrating a mounting rail of one embodiment of the present invention.
Figure 2A:
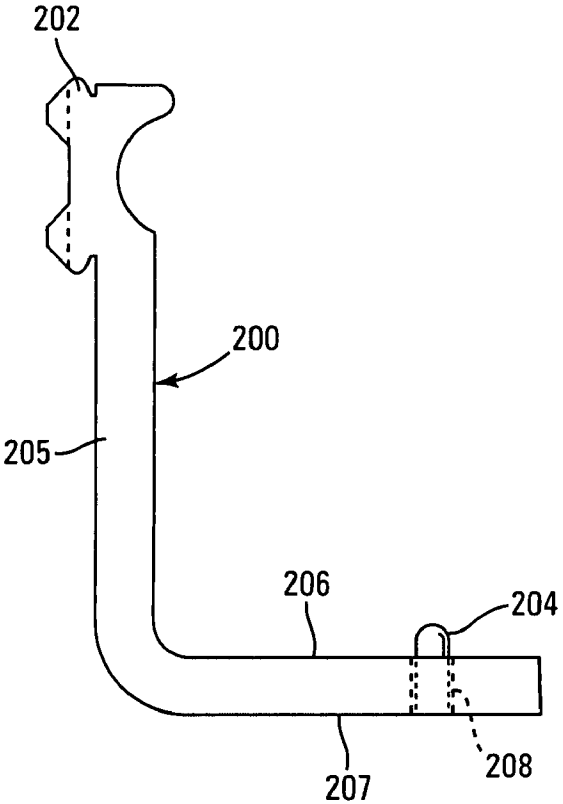
FIG. 2A is a side view of a mount of one embodiment of the present invention.
Figure 2C:
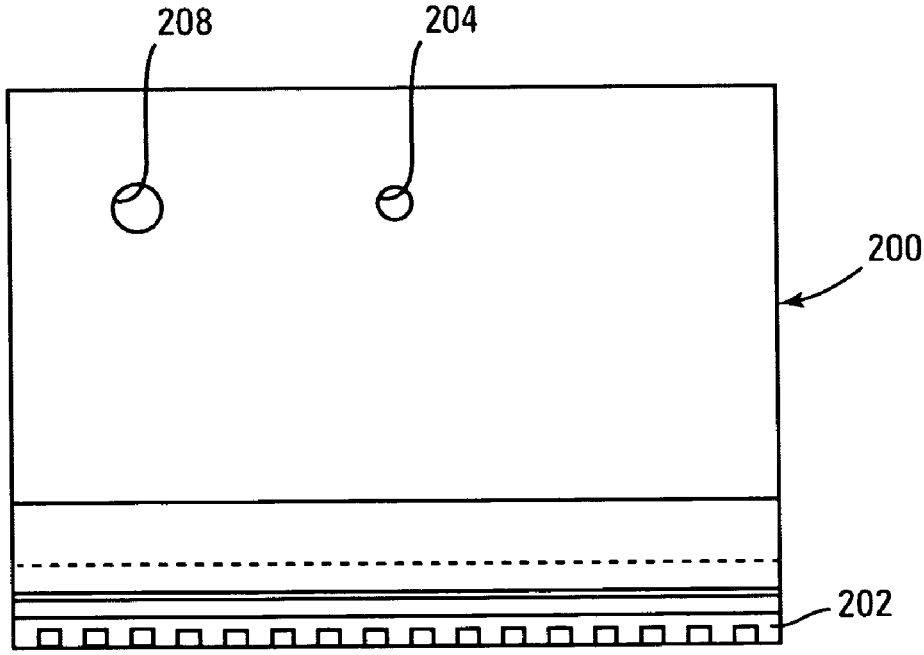
FIG. 2C is a top view of the mount of FIG. 2A.

FIG. 2A is a side view of a mount 200 of one embodiment of the present invention. The mount is used in embodiments of the present invention to mount a device to the weapon. The mount 200 includes a side plate 205 and a support plate 207 that generally makes the shape of an L. In particular, the support plate 207 extends from a first end of the side plate 205 at generally a right angle. The support plate 207 includes an engaging surface 206 to support a device and a stabilizing nub 204 designed to fit into a cavity of a device to provide stability and prevent the rotation of the device when mounted to the mount 200. The support plate 207 also includes a mounting aperture 208. The mounting aperture 208 is designed to allow a thumb screw (or any type of attaching device) to engage the device so that the device can be selectively coupled to the engaging surface 206 of the mount 200. The side plate 205 includes a mounting rail (or rail mount) 202 that is located near a second end of the side plate 205 that is opposite the first end of the side plate 205. As illustrated, the mounting rail 202 extends from the side plate 205 in a direction that is opposite the direction the support plate 207 extends from the side plate 205. FIG. 2B illustrates a back view of the mount 200 and in particular the mounting rail 202. FIG. 2C illustrates a top view of the mount 200 and in particular the stabilizing pin 204 and the mounting aperture 208.

Figure 3A:
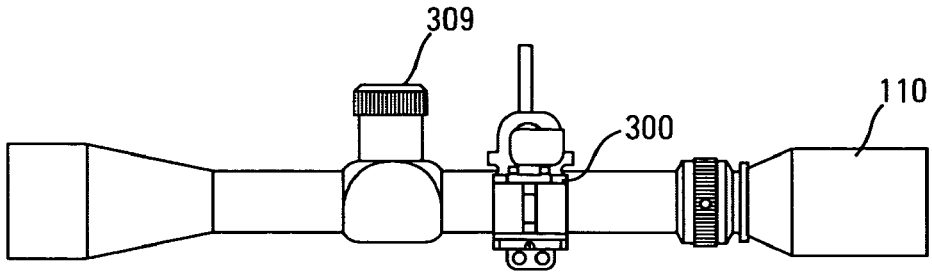
FIG. 3A is a side view of a scope mount with a locking rod mechanism.
Figure 3B:
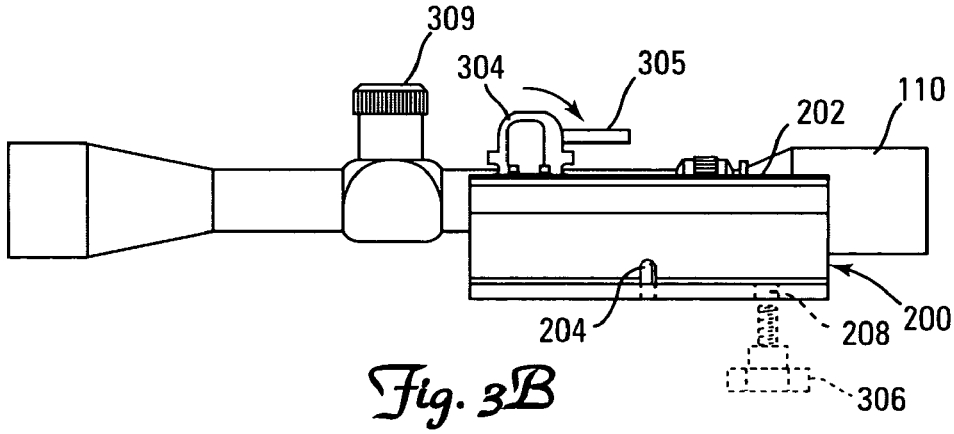
FIG. 3B is a side view of a scope mount engaging a mount of one embodiment of the present invention.
Figure 3C:
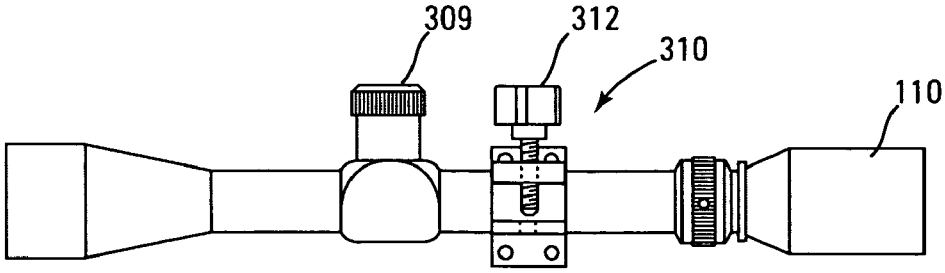
FIG. 3C is a side view of a scope mount with a thumb screw locking mechanism.

FIG. 3A illustrates a side view of a scope 110 with a quick mount scope mount 300 attached thereto. Also illustrated is the adjustment knob 304 of the scope 300 which adjusts the elevation and/or windage of the scope. It is important that the mount 200 and the device using the mount not interfere with the operations of the scope such as the operation of the adjustment knob 304. FIG. 3B illustrates a mount 200 coupled to the scope 110 via the scope mount 300. In particular, the scope mount 300 engages the mounting rail 202 of mount 200. In this embodiment, the scope mount 300 locks the mount onto the scope via a locking mechanism having a locking rod 305 that is rotated into a locking position. In the embodiment of FIG. 3C, a scope mount 310 of one embodiment of the present invention is illustrated. The scope mount 310 includes a threaded thumb screw 312 with a triangle shaped head. The triangle shaped head allows for the applying of a twisting pressure to selectively lock and unlock the scope mount 312 to the scope 110 without the use of a screwdriver.

Figure 4:
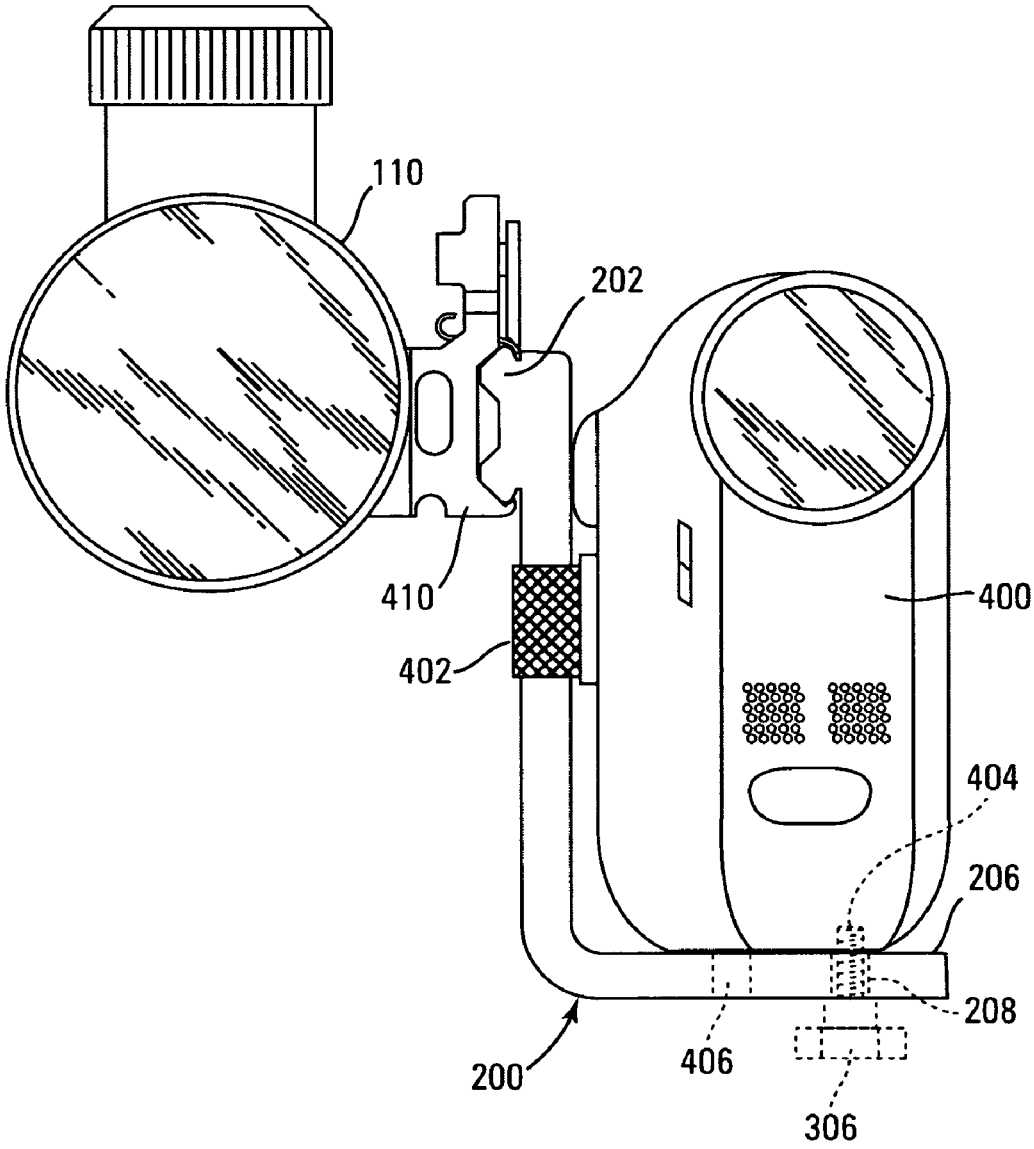
FIG. 4 is a front view of a mount of FIG. 2A attaching a camera to a scope.
Figure 5:
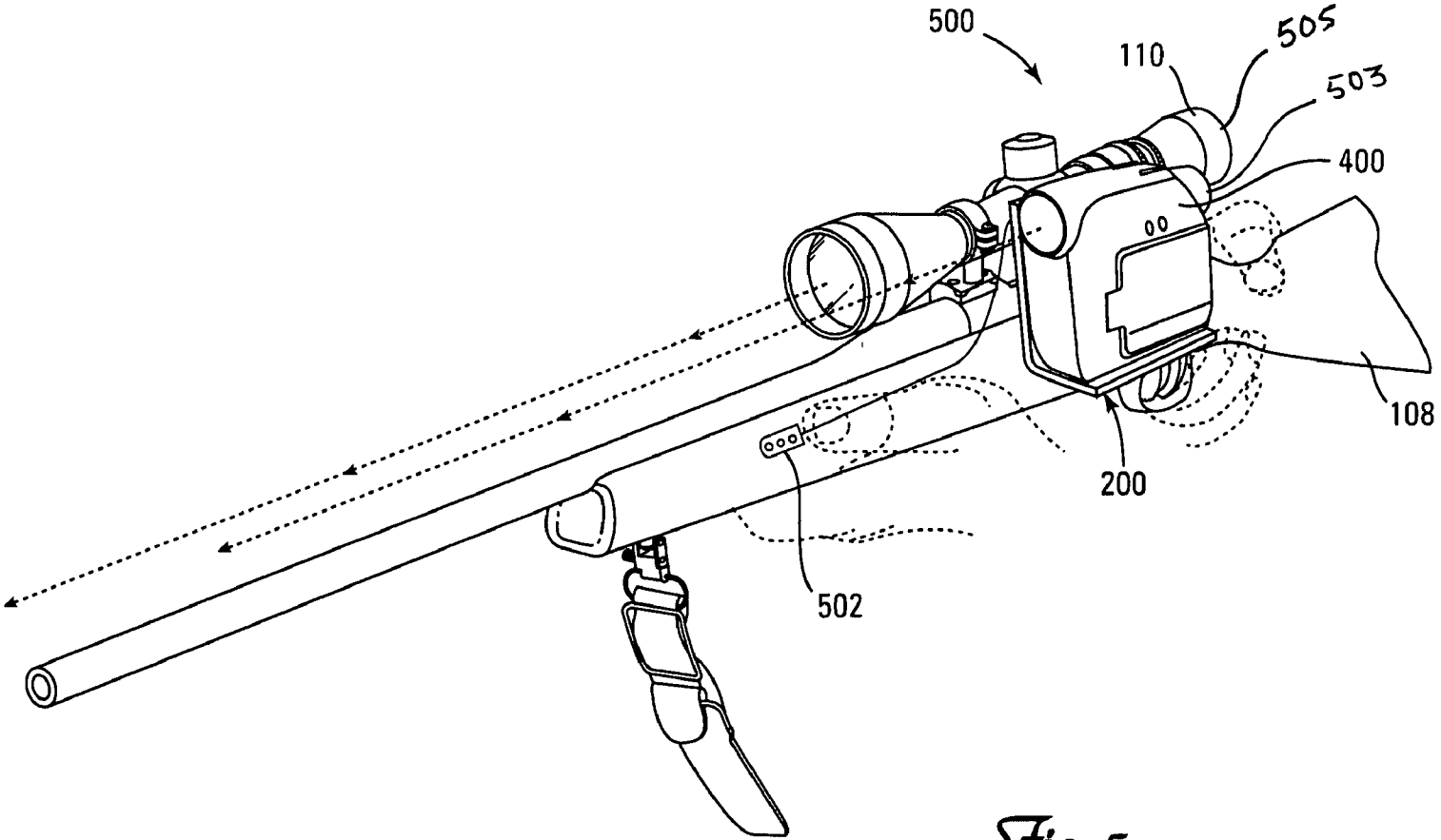
FIG. 5 is a side view of a mount of FIG. 2A attaching a camera to a rifle.

Referring to FIG. 4, a front view of the mount 200 attaching a video camera 400 to a scope 110 of one embodiment of the present invention is illustrated. As illustrated, a bottom side of camera 400 is positioned to abut the engaging surface 206 of the mount 200. The thumb screw mounting aperture 208 allows a triangular shaped head thumb screw 306 to be threaded into internal threads 404 of the camera 400 to secure the camera to the mount 200. Moreover, a hand strap 402 of the camera 400 can be wrapped around the mount as illustrated to further secure the camera to the mount 200. FIG. 4 further illustrates how the mounting rail 202 of the mount 200 is engaged with the scope mount 410. FIG. 5 illustrates the mounting system 500 on a rifle 108. As illustrated, the mount 20 allows for the camera to be mounted away from the elevation adjustment knob 309 of the scope 110. Moreover, as illustrated the eyepiece 503 of camera 400 is approximately at the same height as the eyepiece 505 of the scope 110 in relation to the hunter. That is, the eyepiece 503 of the camera 400 is basically at eye level with the aiming mechanism of the firearm. Accordingly, the hunter's movement to look between the scope and the view finder on the camera is minimal to avoid disruption of the hunt. This also applies to other devices such as a rangefinder with a display that is positioned relatively at eye level with the scope as illustrated in FIG. 1B. Also illustrated in FIG. 5 is a remote control pad 502 that is designed to control the camera 400.

Figure 6:
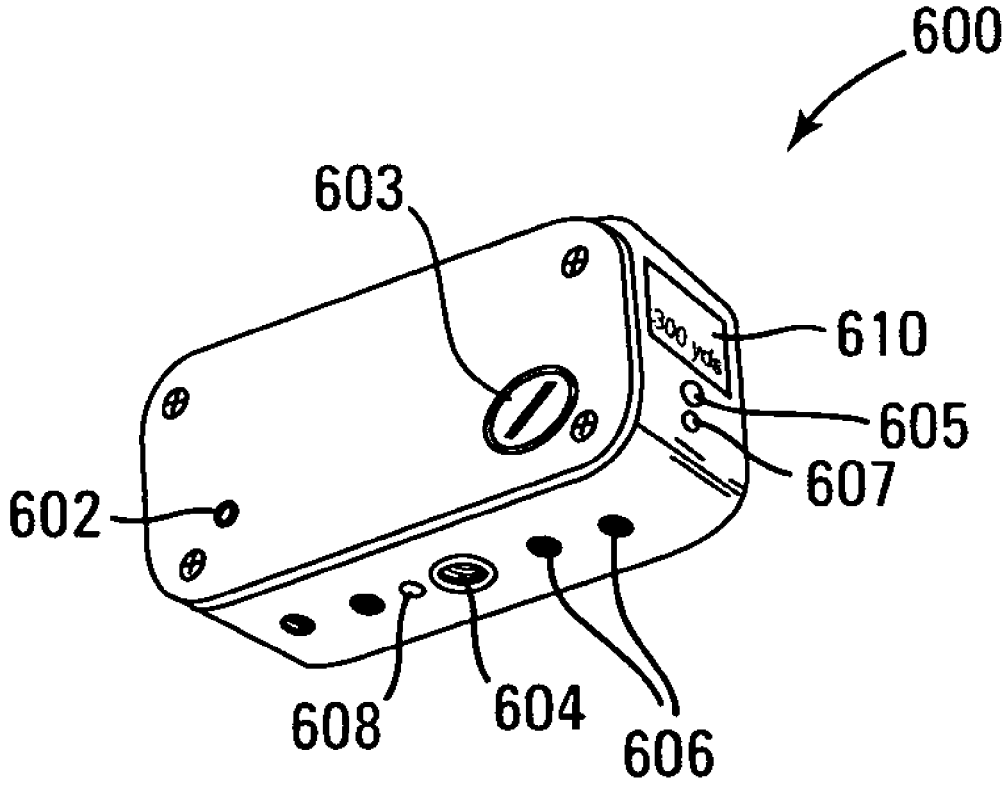
FIG. 6 is a side perspective view of a rangefinder of one embodiment of the present invention.

An example of a rangefinder 600 of one embodiment of the present invention is illustrated in FIG. 6. Rangefinder 600 includes attaching threads 604 adapted to engage the threads of a thumb screw. Accordingly, the rangefinder can be attached to the mounting plate 200 similar to the camera 400 of FIG. 4. This embodiment is illustrated in FIG. 1B. The rangefinder 600 also includes display 610, a power button 605, a mode switch button 607, a battery cover 603 and a remote control port 602 that allows for the remote operation of the rangefinder 600. Moreover, the bottom surface of the rangefinder 600 further includes 606 attaching apertures 606. The attaching apertures 606 are used to mount a mounting rail to the rangefinder 600. The bottom surface of the rangefinder 600 further includes a stabilizing recess 608 that is designed to receive a stabilizing nub such as the stabilizing nub 204 on mount 200. In this embodiment, the battery cover 603 and the remote control port 602 are positioned on a left side of the rangefinder 600 so that when the rangefinder 600 is mounted to a mount 200 as illustrated in FIG. 1B, the battery compartment and the port 602 are assessable. In another embodiment, where the mount 200 is mounted to the other side of the scope 110, the battery cover 603 and the remote control port 602 are positioned on a right side of the rangefinder 600 to allow access to the battery chamber and the port 602 when mounted to the mount 200 in this embodiment. In addition, as illustrated in FIG. 1B, the placement of the power button 605 and mode switch button 607 on a rear side of the rangefinder 600 allows for the ease of operation of the rangefinder 600 while the firearm is shouldered in a shooting position.

Figure 7A:
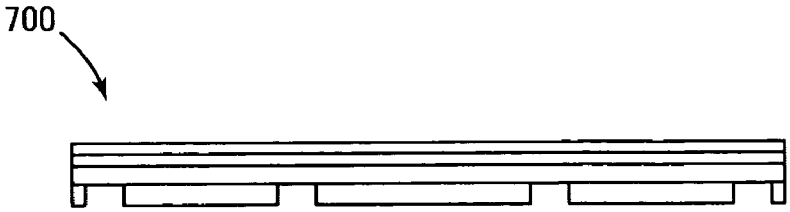
FIG. 7A is a side view of a mounting rail of one embodiment of the present invention.
Figure 7B:
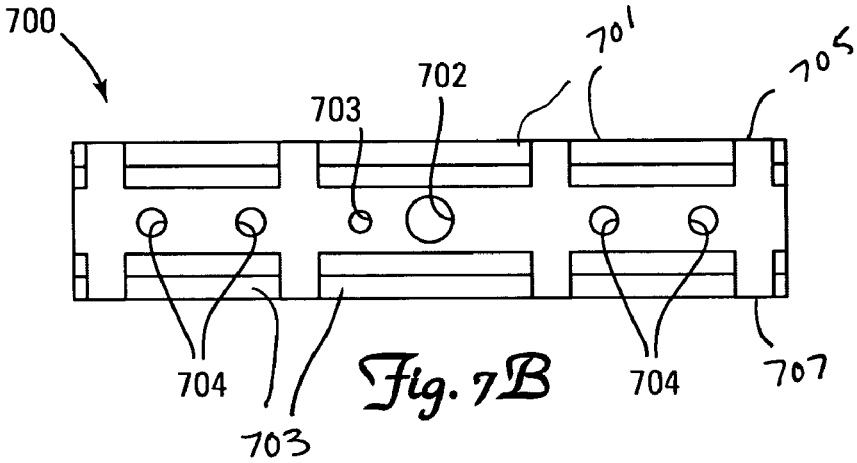
FIG. 7B is a top view of the mounting rail of FIG. 7A.
Figure 8:
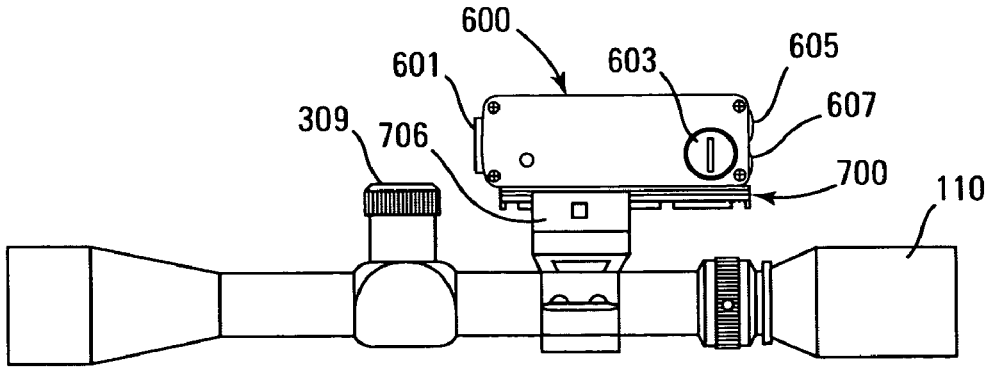
FIG. 8 is a side view of a rangefinder being attached to a scope of one embodiment of the present invention.
Figure 9:
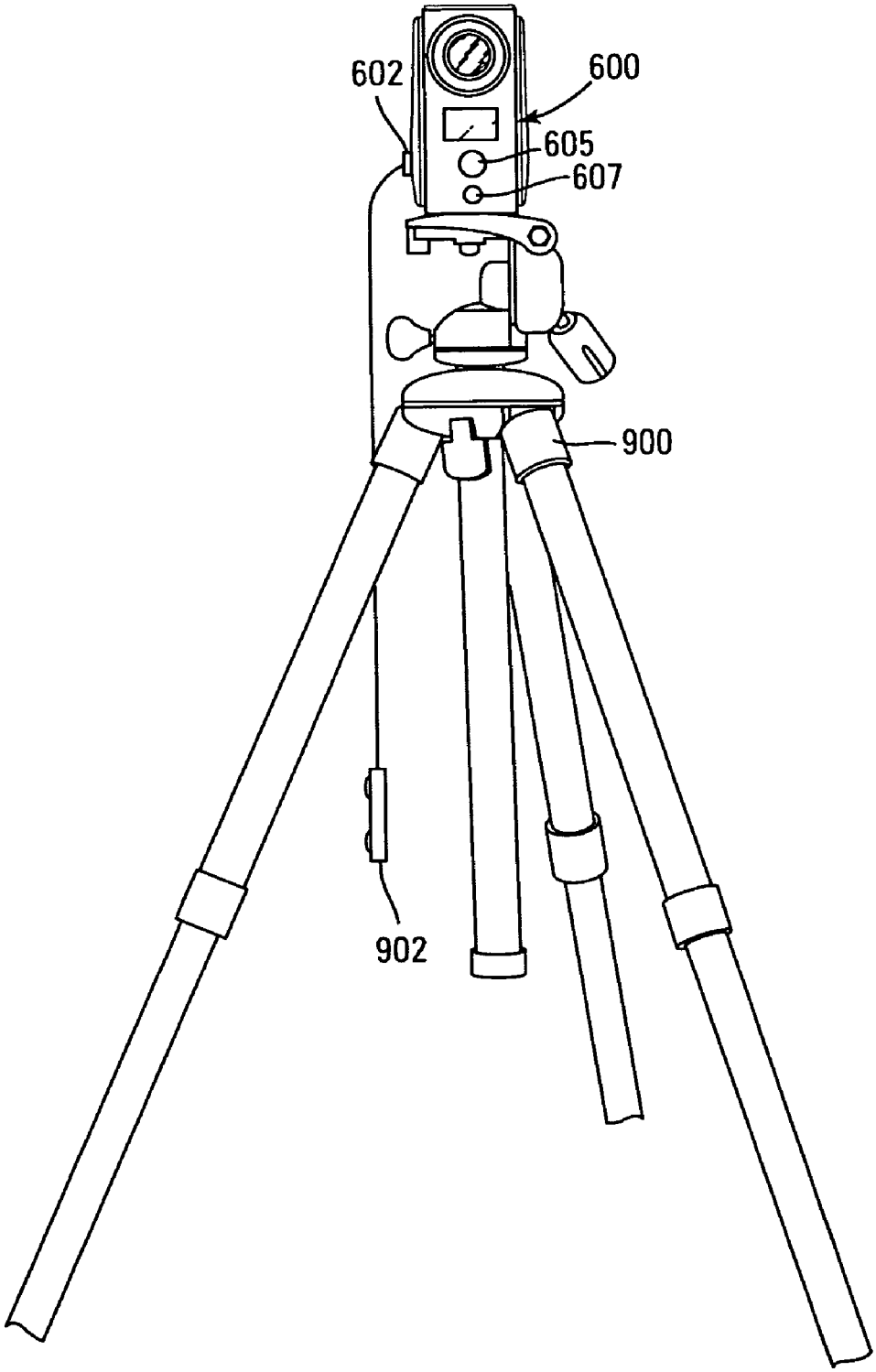
FIG. 9 is a front view of the rangefinder of FIG. 6 attached to a tripod.

An example of a mounting rail 700 of one embodiment of the present invention is illustrated in FIGS. 7A and 7B. The mounting rail 700 of this embodiment includes rail apertures 704 that are adapted to be aligned with the attaching apertures of the rangefinder 606 of other device. Screws or other attachment means are used to secure the rangefinder 606 to the mounting rail 700 through the rail apertures 704 and the associated attaching apertures 606. Further illustrated is a stabilizing recess 703. This stabilizing recess is also designed to receive a stabilizing nub such as the stabilizing nub 204 on mount 200. The rail apertures 704, stabilizing nub as well as a rail thumb screw aperture 702 are positioned between a first edge 075 and a second edge 707 of the mounting rail 700. Moreover as illustrated, a first rail 701 is positioned along the first edge 705 and a second rail 703 is positioned along a second edge 707 of the mounting rail 700. An illustration of a rangefinder attached to a scope 110 using the mounting rail 700 and a scope mount 706 is illustrated in FIG. 8. As illustrated in this embodiment, the mounting rail 700 is directly coupled to the scope mount 706. In other embodiments, the mounting rail 700 is coupled to a mount 200 that is coupled to the scope mount 706. In these embodiments, the mount rail thumb screw aperture 702 is used to connect the mounting rail 700 and rangefinder 600 to the mount 200 via a thumb screw. The attaching threads 604 of the rangefinder 600 can also be used to mount the rangefinder 600 to a tripod 900 as illustrated in FIG. 9. As also illustrated in FIG. 9, the rangefinder 600 can be remotely operated by a remote control pad 902 that is in communication with the remote control port 602.

Figure 10:
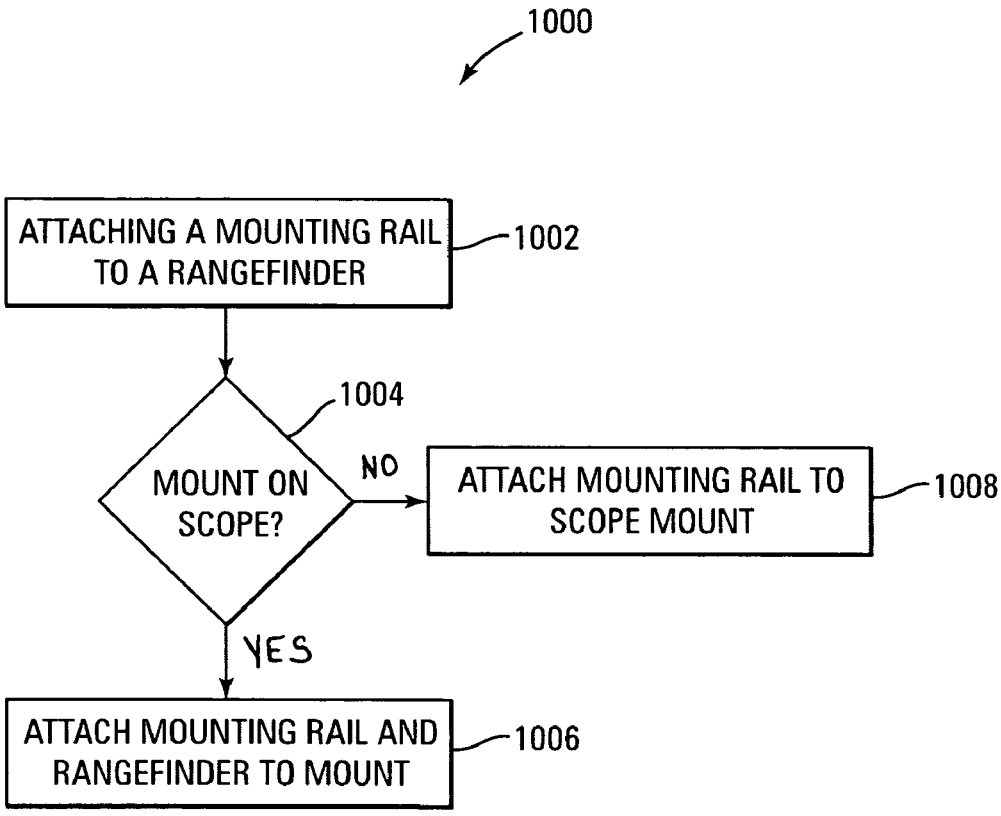
FIG. 10 is a flow diagram of one embodiment of the present invention.

One method of using a rangefinder 600 and a mount rail (or mounting rail) 700 of one embodiment of the present invention is illustrated in FIG. 10. As illustrated, the method begins by attaching a mounting rail 700 to the rangefinder 600 (1102). In one embodiment, as illustrated in FIGS. 6 and 8 the attachment is at the bottom of the rangefinder. This illustration however, is shown by way of example and not by limitation. Accordingly, the location of the attachment of the mounting rail 700 is not limited to the bottom of the rangefinder. It is then determined if a mount 200 is already on the scope (1004). If a mount 200 is not on the scope (1004), the mounting rail 700 is directly attached to a scope mount 706 as illustrated in FIG. 8. If a mount 200 is already on the scope (1004), the rangefinder 600 is attached to the mount 200 as illustrated in FIG. 1B.

Figure 11:
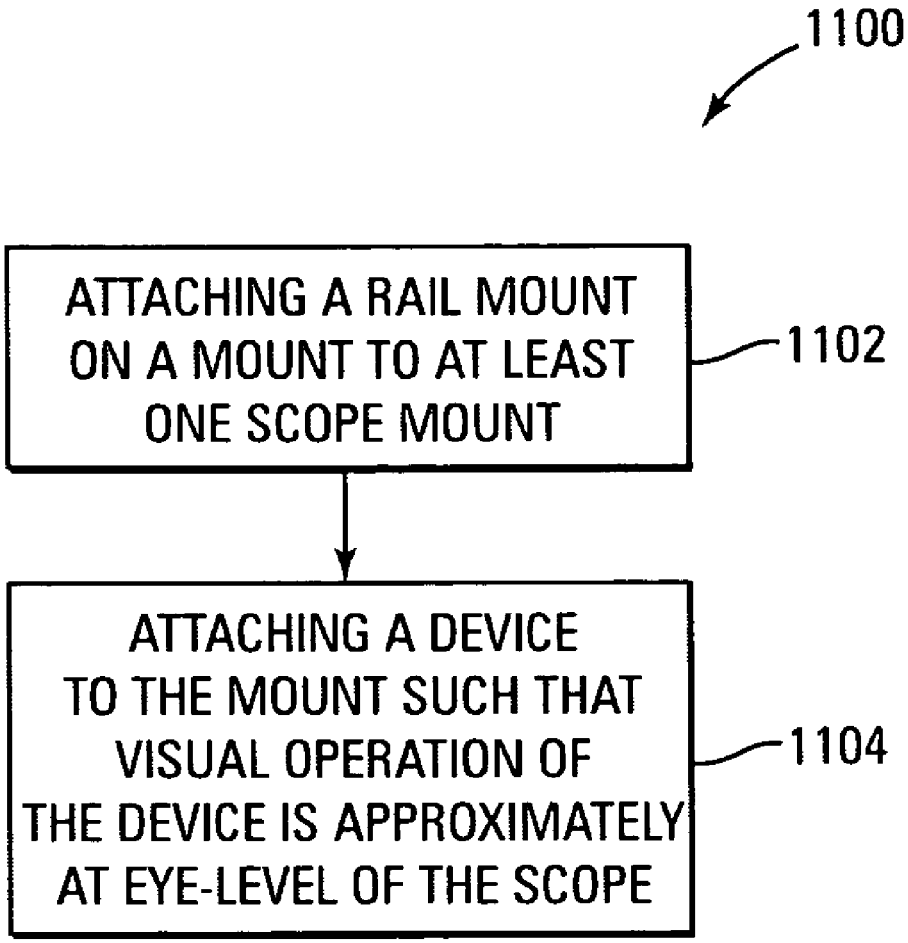
FIG. 11 is another flow diagram of another embodiment of the present invention.

As discussed above, the mount 200 can be used by a plurality of devices. One method of using the mount with devices in one embodiment of the present invention is illustrated in FIG. 11. As illustrated, a rail mount 202 on the mount 200 is first attached to at least one scope mount 304 (1101). This is illustrated in FIG. 3B. The device is then attached to the mount (1104). In one embodiment, the visual operation of the device is positioned by the mount to be at eye level with an aiming mechanism of the firearm which is in this embodiment, an eye piece of the scope. For example, as discussed above, with a video camera device 400 (of FIG. 5), the eyepiece 503 of the camera 400 is positioned approximately at eye level with the eyepiece 505 of the scope 110 and with the rangefinder example the display on the range finder is positioned approximately at eye level with the eyepiece of the scope (FIG. 1B).

Figure 12:
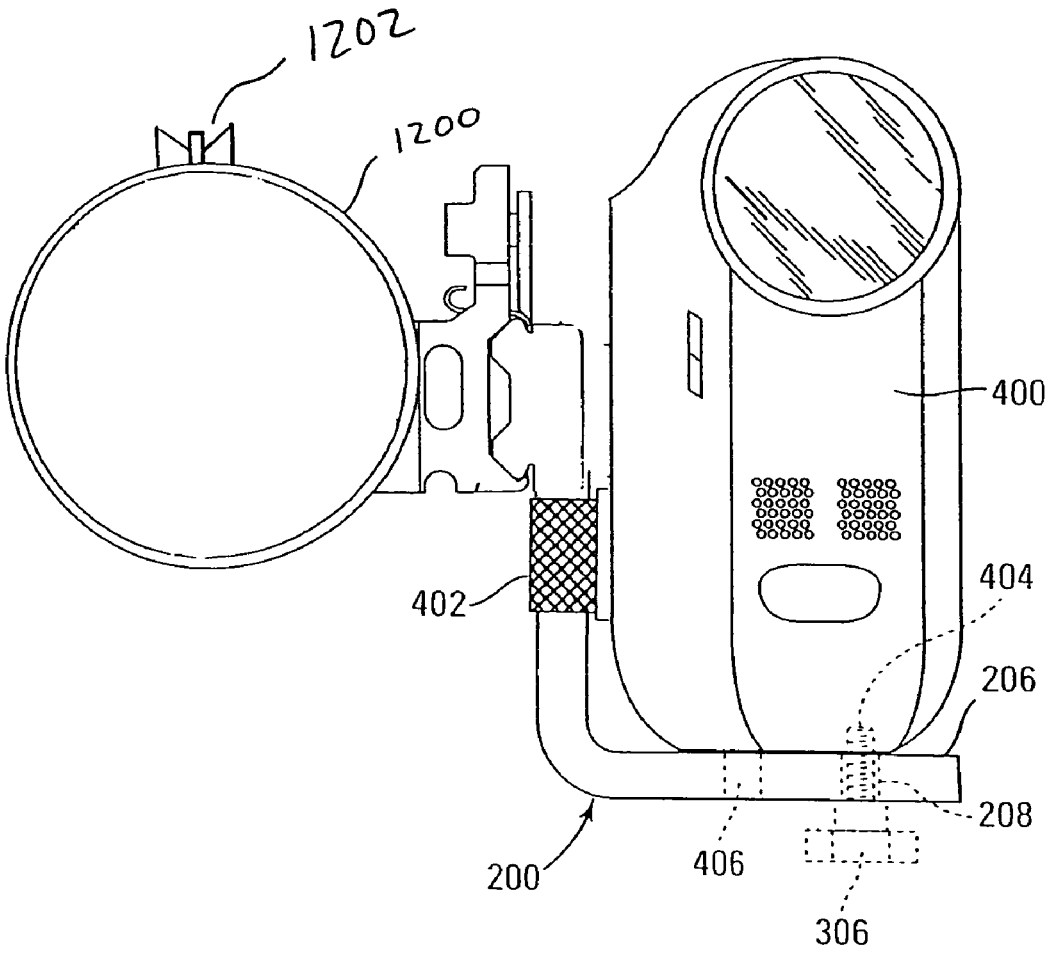
FIG. 12 is a front view of a mount of one embodiment of the present invention mounted to a barrel of a firearm.

Although, the above examples of the embodiments of the present invention illustrate a device being coupled to a scope of a firearm, other embodiments attach the device directly to a barrel of a firearm. For example, please refer to FIG. 12. In the embodiment of FIG. 12, a mount 200 is coupled directly to a barrel 1200 of a firearm via scope mount 410. That is, in this embodiment, the scope mount 410 is directly coupled to the barrel 1200 and not a scope. Also illustrated in FIG. 12 is the aiming mechanism 1210 of the firearm which is, in this embodiment, approximately at eye level with the operating device of the video camera 400. Accordingly, the above embodiments of the present invention are not limited to being mounted to a scope.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A device mount for mounting a device to a weapon having a scope, the device mount comprising:

an L-shaped mounting bracket having a horizontal support portion and a vertical side portion extending upwardly from one side of the horizontal support portion; and a mounting rail having an upper rail at a top of the vertical side portion and a lower rail located below and parallel to the upper rail; and a scope ring for attaching the L-shaped mounting bracket to the scope of the weapon, the scope ring including a clamp for releasably engaging the upper and lower mounting rails.

2. The device mount of claim 1, wherein the upper rail is adjacent and parallel to a top edge of the vertical side portion.

3. The device mount of claim 1, further comprising:

an aperture extending through the horizontal support portion.

4. The device mount of claim 3, further comprising:

a thumb screw for extending through the aperture and engaging the device thereby securing the device to the horizontal support portion.

5. The device mount of claim 1, further comprising:

a stabilizing nub extending upwardly from the horizontal support portion for stabilizing the device with respect to the device mount.

6. The device mount of 1, wherein the horizontal surface and the vertical surface are rectangular in shape.

7. The device mount of 1, wherein front and back ends of the horizontal support portion and front and back ends of the vertical side portion, respectively, are aligned with each other.

8. The device mount of 7, wherein the front end of the horizontal support portion and the front end of the vertical side portion are continuous and form an approximately right angle.

9. The device mount of 8, wherein the back end of the horizontal support portion and the back end of the vertical side portion are continuous and form an approximately right angle.

10. A device mount for mounting a device to a weapon having a scope, the device mount comprising:

an L-shaped mounting bracket having a horizontal support portion and a vertical side portion;

a mounting rail integral with the vertical side portion and extending in a direction parallel to an upper edge of the vertical side portion; and a scope ring for attaching the L-shaped mounting bracket to one side of the scope, the scope ring including a ring for attachment to the scope and a clamp for attachment to the mounting rail.

11. The device mount of claim 10, wherein the device is a video camera.

12. The device mount of claim 10, wherein the device is a rangefinder.

13. The device mount of claim 10, wherein the horizontal support plate supports the device so that an eyepiece of the device is positioned at approximately a same height as an eyepiece of the scope when the device is mounted on the horizontal support plate and the scope ring attaches the L-shaped mounting bracket to the scope.

14. The device mount of claim 10, wherein the horizontal support has an aperture extending therethrough for receiving a thumb screw.

15. The device mount of claim 10, wherein the scope ring has a lock for securing attachment between the clamp and the mounting rail.

16. The device mount of claim 15, wherein the scope includes a threaded screw for securing the scope ring to the scope.

* * * * *